US010869138B2

(12) United States Patent
Straeussnigg et al.

(10) Patent No.: US 10,869,138 B2
(45) Date of Patent: Dec. 15, 2020

(54) MEMS MICROPHONE

(71) Applicant: Infineon Technologies AG, Neubiberg (DE)

(72) Inventors: Dietmar Straeussnigg, Villach (AT); Bernd Cettl, Finkenstein (AT)

(73) Assignee: INFINEON TECHNOLOGIES AG, Neubiberg (DE)

( * ) Notice: Subject to any disclaimer, the term of this patent is extended or adjusted under 35 U.S.C. 154(b) by 0 days.

(21) Appl. No.: 16/418,181

(22) Filed: May 21, 2019

(65) Prior Publication Data

US 2019/0373376 A1 Dec. 5, 2019

(30) Foreign Application Priority Data

Jun. 5, 2018 (EP) ..... 8176062

(51) Int. Cl.
*H04R 19/04* (2006.01)

(52) U.S. Cl.
CPC ..... *H04R 19/04* (2013.01); *H04R 2201/003* (2013.01)

(58) Field of Classification Search
CPC .. H04R 19/04; H04R 2201/003; H04R 1/003; H04R 3/00; H04R 3/06; H04R 29/004; H04R 3/005; H04R 3/04; H04R 1/04; H04R 1/406; H04R 23/00; H04R 2410/00; H04R 3/02
USPC ..... 381/174, 315, 318, 317
See application file for complete search history.

(56) References Cited

U.S. PATENT DOCUMENTS 5,552,785 A * 9/1996 Wilson ..... H03H 17/0614 341/143
2007/0223724 A1* 9/2007 Miyazaki ..... H04R 3/00 381/77
2009/0316935 A1* 12/2009 Furst ..... H03F 3/181 381/111
2017/0077946 A1 3/2017 Christen et al.

FOREIGN PATENT DOCUMENTS

CN 107040831 A 8/2017
EP 3236588 A1 10/2017

* cited by examiner

*Primary Examiner* — Fan S Tsang
*Assistant Examiner* — Julie X Dang
(74) *Attorney, Agent, or Firm* — Slater Matsil, LLP

(57) ABSTRACT

Embodiments provide a MEMS microphone comprising a MEMS microphone unit and a modulator connected downstream the MEMS microphone unit. The modulator is configured to apply a defined phase shift to a signal to be modulated.

9 Claims, 9 Drawing Sheets

MEMS MICROPHONE

This application claims the benefit of European Application No. 18176062, filed on Jun. 5, 2018, which application is hereby incorporated herein by reference in its entirety.

TECHNICAL FIELD

Embodiments relate to a MEMS microphone.

BACKGROUND

When using certain input signals (e.g. constant input signal), undesired tones (limit cycles) occur in sigma-delta ADCs and digital modulators. For example, tones may arise in the useful band, which are particularly problematic (audible) in audio applications. On the other hand, particularly when using single-bit modulators, strong limit cycles occur around Fs/2.

Said limit cycles cause interference effects (stereo noise) in the useful band, e.g., in stereophonic microphone applications. Interfering components may also arise in the useful band due to intermodulation of limit cycles around half of the sampling rate Fs/2 and interference on the reference.

A common method for minimizing limit cycles is adding a so-called dither signal (pseudo random signal). This signal is usually fed in in front of the quantizer. A disadvantage of this method is that it reduces the SNR (particularly when using single-bit modulators, unacceptably high levels would have to be used for the dither signal in order to minimize the limit cycles around half of the sampling rate Fs/2).

SUMMARY

Embodiments provide a MEMS microphone comprising a MEMS microphone unit and a modulator connected downstream the MEMS microphone unit. The modulator is configured to apply a defined phase shift to a signal to be modulated.

BRIEF DESCRIPTION OF THE DRAWINGS

Embodiments are described herein making reference to the appended drawings.

DETAILED DESCRIPTION OF ILLUSTRATIVE EMBODIMENTS

In the following description, a plurality of details are set forth to provide a more thorough explanation of embodiments of the present invention. However, it will be apparent to one skilled in the art that embodiments of the present invention may be practiced without these specific details. In other instances, well-known structures and devices are shown in block diagram form rather than in detail in order to avoid obscuring embodiments of the present invention. In addition, features of the different embodiments described hereinafter may be combined with each other, unless specifically noted otherwise.

As already mentioned above in the section background, when using certain input signals (e.g. a constant input signal), undesired tones (limit cycles) occur in sigma-delta ADCs and digital modulators. For example, tones, such as idle tones, may arise in the useful band, which are particularly problematic (audible) in audio applications. On the other hand, particularly when using single-bit modulators, strong limit cycles occur around Fs/2.

Said limit cycles cause interference effects (stereo noise) in the useful band, e.g., in stereophonic microphone applications. Interfering components may also arise in the useful band due to intermodulation of limit cycles around half of the sampling rate Fs/2 and interference on the reference.

Further, when using two microphones operated in stereo, interference effects (stereo noise) may arise.

This effect will first be explained in detail with reference to FIGS. 1 and 2, before subsequently embodiments of the present invention are described with reference to FIGS. 3 to 11.

Figure 1:
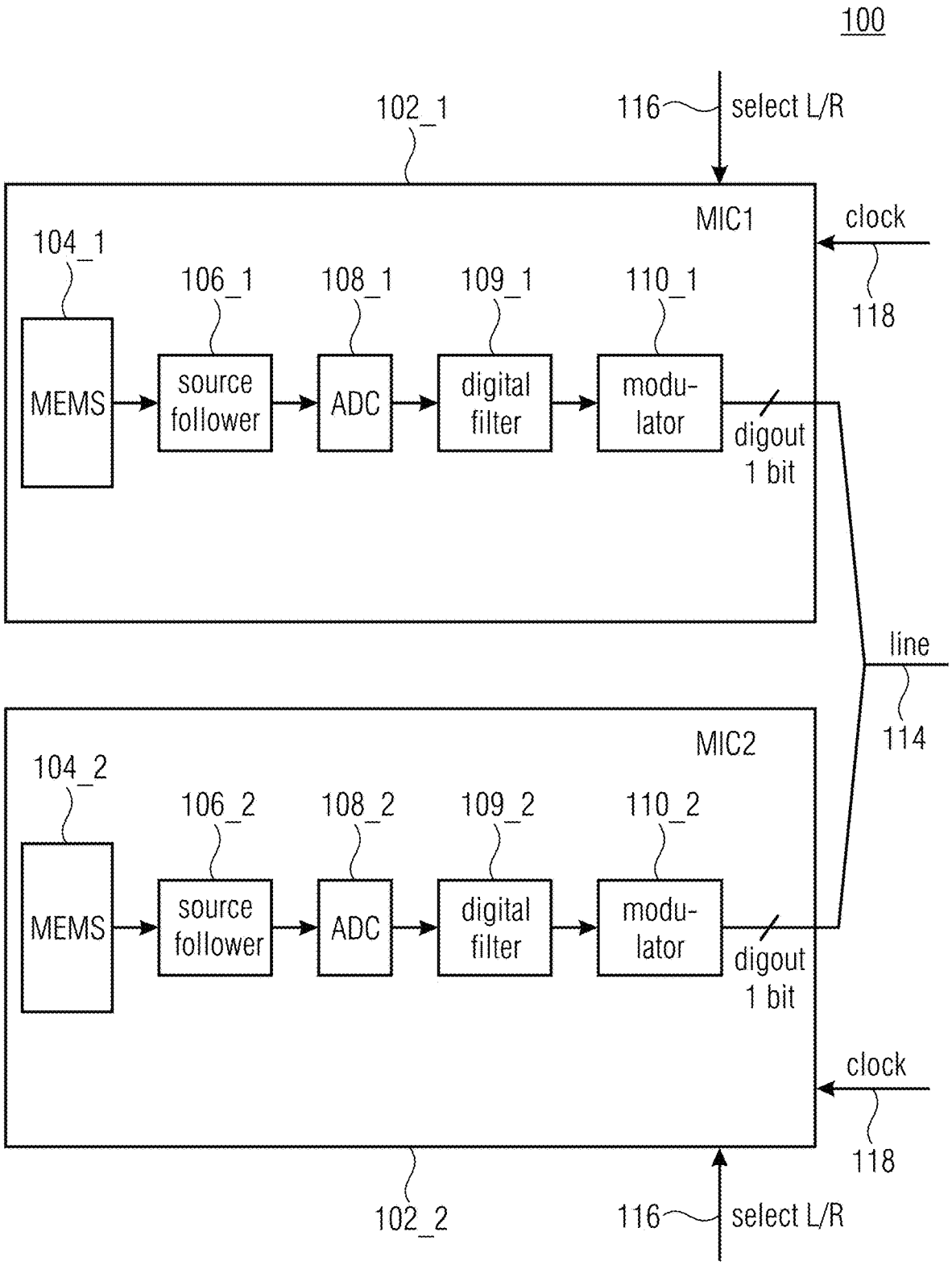
FIG. 1 shows a schematic block diagram of a MEMS microphone module comprising a first MEMS microphone and a second MEMS microphone.

FIG. 1 shows a schematic block diagram of a MEMS microphone module 100 comprising a first MEMS microphone 102_1 and a second MEMS microphone 102_2. In other words, FIG. 1 shows a schematic block diagram of a stereo mode application.

The first MEMS microphone 102_1 comprises a first MEMS microphone unit 104_1, a first amplifier unit 106_1 (e.g., a source follower), a first analog-to-digital converter (ADC) 108_1, a first digital filter 109_1 and a first modulator 110_1. The second MEMS microphone 102_2 comprises a second MEMS microphone unit 104_2, a second amplifier unit 106_2 (e.g., a source follower), a second analog-to-digital converter (ADC) 108_2, a second digital filter 109_2 and a second modulator 110_2.

As shown in FIG. 1, the two MEMS microphones 102_1 and 102_2 can be connected via a single line 114, for example, to a digital signal processor (DSP). A configuration bit 116 (select L/R) can be used to determine which MEMS microphone 102_1 and 102_2 is scanned with the rising edge of the clock and which is scanned with the falling edge of the clock. Additional power dissipation originating from charge-reversal effects causes interference (stereo noise) in the audio band via the thermo-acoustic effect. The stereo noise causes deterioration in performance (SNR).

Figure 2:
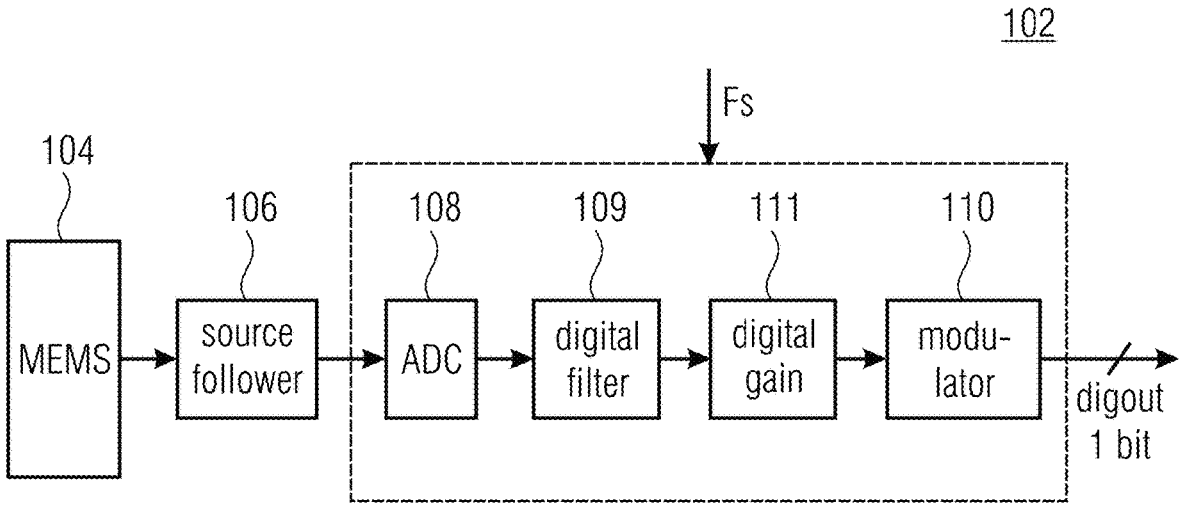
FIG. 2 shows a schematic block diagram of a digital MEMS microphone.

In addition to other parameters (e.g. supply voltage), the stereo noise is mainly determined by the limit cycles of the digital modulators, as shown in FIG. 2.

In detail, FIG. 2 shows a schematic block diagram of a digital MEMS microphone 102. The digital MEMS microphone 102 comprises a MEMS microphone unit 104, an amplifier unit 106 (e.g., a source follower), an analog-to-digital converter (ADC) 108, a digital filter 109, a digital gain unit in and a digital modulator no. As indicated in FIG. 2, the analog-to-digital converter (ADC) 108, the digital filter 109, the digital gain unit in and the digital modulator no are operated with a clock frequency Fs (or sampling frequency or sampling rate).

When using single-bit modulators, strong limit cycles occur around half of the sampling frequency Fs/2 as a matter of principle. If the limit cycles around half of the sampling frequency Fs/2 are successfully reduced or even minimized, the stereo noise is also reduced.

Subsequently, embodiments are described which reduce the limit cycles around half of the sampling frequency Fs/2.

Figure 3:
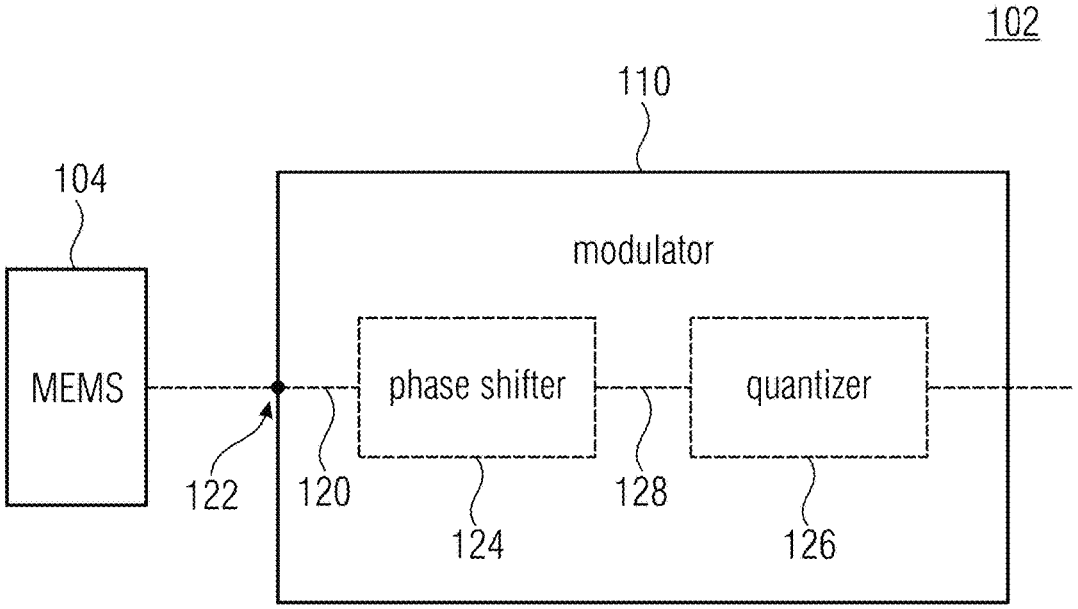
FIG. 3 shows a schematic block diagram of a MEMS microphone according to an embodiment.

FIG. 3 shows a schematic block diagram of a MEMS microphone 102 according to an embodiment. The MEMS microphone 102 comprises a MEMS microphone unit 104 and a modulator no connected downstream the MEMS microphone unit 104. The modulator no is configured to apply (e.g., prior to modulation) a defined phase shift to a signal 120 to be modulated, e.g., a signal provided by the MEMS microphone unit 104 or a signal derived therefrom, such as a signal 120 present at an input 122 of the modulator 110 or a signal derived therefrom (e.g., a filtered version of the signal 120 present at the input 122 of the modulator no; e.g., a signal of a signal chain of the modulator).

In embodiments, limit cycles (e.g., around half of the sampling frequency Fs/2) can be reduced by applying the phase shift to the signal 120 to be modulated.

In embodiments, the modulator no can be a digital modulator or an analog-to-digital converter, such as a sigma-delta analog-to-digital converter (e.g., a switched-capacitor sigma-delta analog-to-digital converter or a continuous time sigma-delta analog-to-digital converter).

In embodiments, the modulator no can be a single bit modulator, i.e. a modulator configured to provide at its output a single bit per sampling period.

As shown in FIG. 3 by way of example, the modulator no can comprise a phase shifter 124 configured to apply the defined phase shift to the signal 120 to be modulated.

Further, the modulator no can comprise a quantizer 126 connected downstream the phase shifter 124. The quantizer 126 can be configured to quantize a phase shifted version 128 of the signal 120 to be modulated provided by the phase shifter 124.

Figure 4:
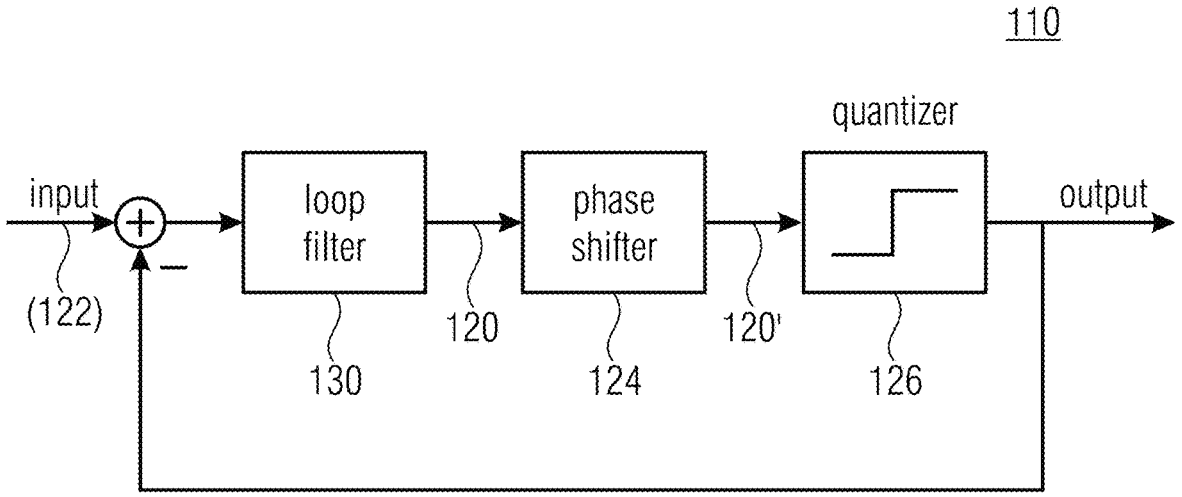
FIG. 4 shows a schematic block diagram of a modulator according to an embodiment.

FIG. 4 shows a schematic block diagram of a modulator no according to an embodiment. As shown in FIG. 4, the modulator no can comprise a phase shifter 124 configured to apply a phase shift to a signal 120 to be modulated. The signal 120 to be modulated can be a signal present at an input 122 of the modulator no or a signal derived therefrom, such as a filtered version of the signal present at the input 122 of the modulator (e.g., filtered by a loop filter 130). Further, the modulator no can comprise a quantizer 126 configured to quantize the signal 120' provided by phase shifter 124, i.e. the phase shifted version 120' of the signal 120 to be modulated.

In embodiments, the modulator no (or more precisely the phase shifter 124) can be configured to apply a delay as the phase shift to the signal 120 to be modulated. For example, the delay can be equal to a sampling period of the signal 120 to be modulated.

In other words, FIG. 4 shows a modulator no with a reduction of limit cycles around half of the sampling rate Fs/2 by means of a phase shifter 124. As illustrated FIG. 4, a phase shifter 124 can be used in the modulator no in order to reduce or even minimize the limit cycles around half of the sampling rate Fs/2. In the simplest case, a delay (one clock period for scanning systems) can be used as a phase shifter. In a feedback system, a dead time (delay) negatively affects the performance, thus, only the necessary amount of dead time is inserted.

Figure 5:
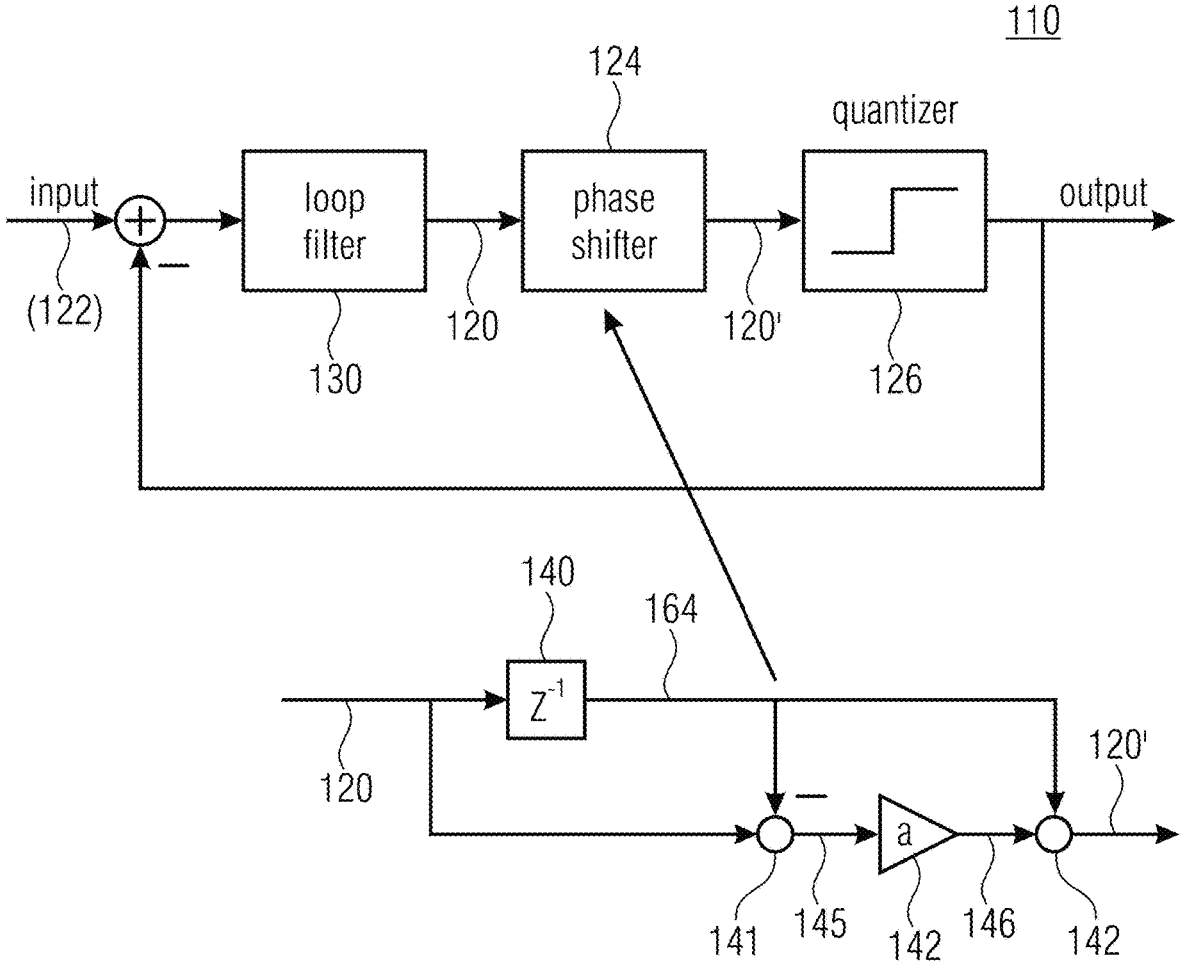
FIG. 5 shows a schematic block diagram of a modulator according to a detailed embodiment.

FIG. 5 shows a schematic block diagram of a modulator no according to a detailed embodiment. The modulator no comprises the loop filter 130, the phase shifter 124 and the quantizer 126, wherein the phase shifter 124 is configured to apply a delay to the signal 120 to be modulated, wherein the delay can be equal to a sampling period of the signal 120 to be modulated or a fraction or a multiple thereof.

The phase shifter 124 can be implemented, for example, by means of a delay 140, a first combiner (e.g., subtractor) 141, a digital gain unit 142 and a second combiner (e.g., adder) 143. The delay 140 can be configured to delay the input signal 120 of the phase shifter (=signal 120 to be modulated) by one sampling period, or a fraction or a multiple thereof, in order to obtain a delayed signal 144. The first combiner 141 (e.g., subtractor) can be configured to combine (e.g., subtract) the input signal 120 and the delayed signal 144, in order to obtain a combined signal 145. The digital gain unit 142 can be configured to apply a variable gain between a=0 and a=2, preferably between a=0 and a=1, to the combined signal 145, to obtain a signal 146. While gain values in the range $0 \leq a \leq 1$ provide better results, the invention could also be implemented with higher gain values (e.g., with a=2). The second combiner 148 (e.g., adder) can be configured to combine (e.g., add) the signal 146 and the delayed signal 144, in order to obtain an output signal 120' of the phase shifter (=delayed version 120' of the signal to be modulated).

In other words, FIG. 5 shows a modulator no with a reduction of limit cycles around half of the sampling rate Fs/2 by means of a phase shifter 124 in detail. Thereby, FIG. 5 shows a modulator 110 having a filter that implements fractional delays (the phase shift is only a fraction of a sampling period). The phase shift can be adjusted with the coefficient a. With a=0, a phase shift of one sampling period is achieved, when selecting a=1, no phase shift occurs. For values in between, the phase shift is in the range of 0 to one sampling period. Naturally, embodiments also work with gain values greater than one (a>1), such as a=2, or gain values in the range between a=1 and a=2 (e.g., $1<a\leq 2$).

In embodiments, in the modulator (ADC or digital modulator), limit cycles can be reduced or even minimized around half of the sampling rate Fs/2 by means of phase shifters. This also reduces or even minimizes stereo noise.

Embodiments described herein provide at least one of the following advantages. First, embodiments enable the reduction of the stereo noise independently of the L/R bit. Second, embodiments avoid an additional offset. Third, embodiments can be combined in a stereo application with microphones from other manufacturers. Fourth, embodiments provide an efficient implementation. Fifth, in embodiments, the phase shift can be implemented to be switchable (level-dependent change of coefficient a), thereby achieving an additional improvement. Sixth, embodiments generally can be used as a dither method for modulators.

The above discussions apply to digital modulators and switched-capacitor sigma-delta ADCs.

Both modulators can be regarded as scanning systems, and the phase shift can take place as described above. However, embodiments also can be applied to continuous-time sigma-delta ADCs. In this case, the phase shift can also occur, e.g., by means of inverter chains.

Subsequently, a detailed embodiment of a digital stereo MEMS microphone module is described.

Figure 6:
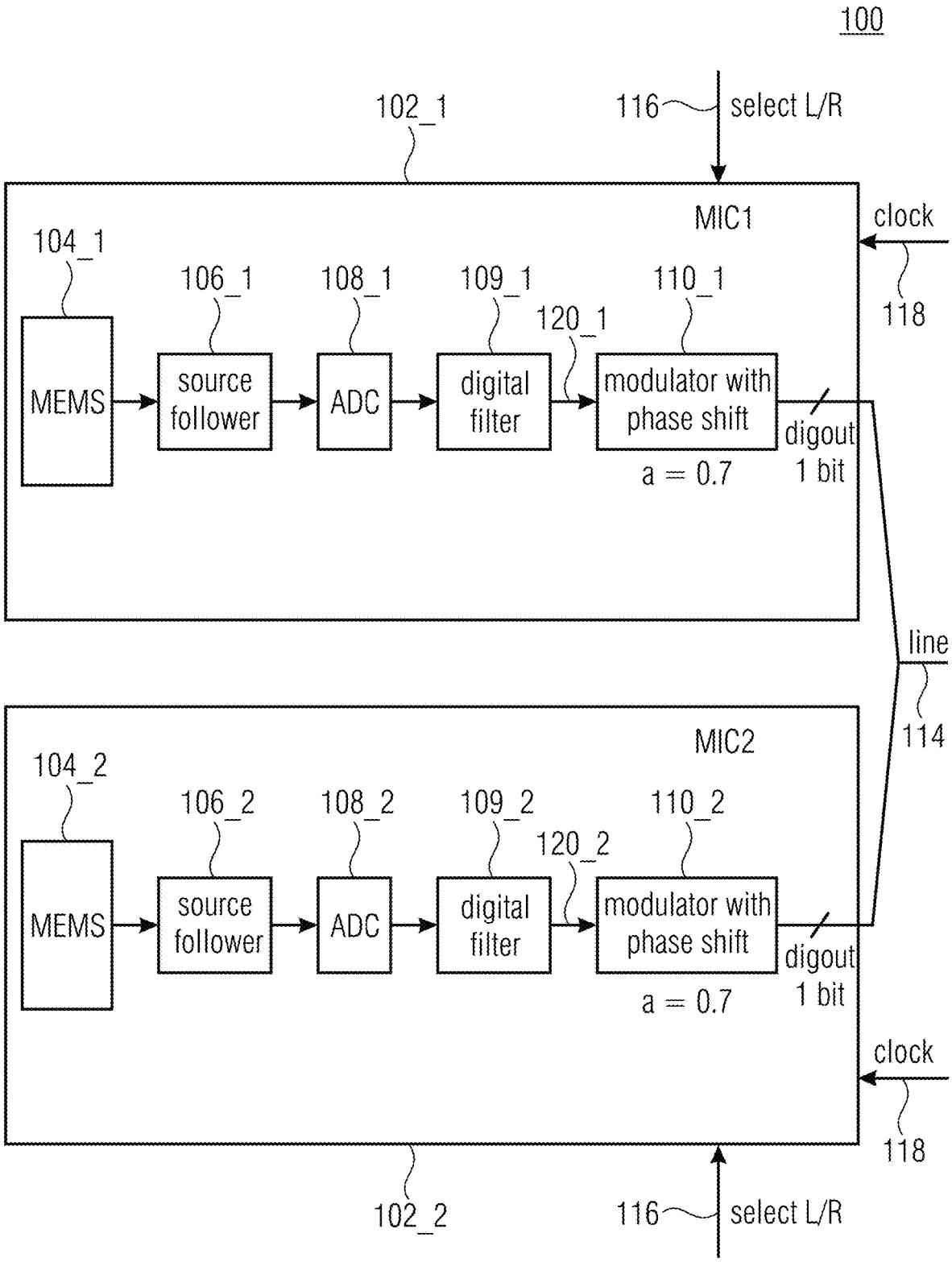
FIG. 6 shows a schematic block diagram of digital stereo MEMS microphone module according to an embodiment.

FIG. 6 shows a schematic block diagram of digital stereo MEMS microphone module 100 according to an embodiment. The digital stereo MEMS microphone module 100 comprises a first digital MEMS microphone 102_1 and a second digital MEMS microphone 102_2.

The first digital MEMS microphone 102_1 comprises a first MEMS microphone unit 104_1, a first amplifier unit 106_1 (e.g., a source follower), a first analog-to-digital converter (ADC) 108_1, a first digital filter 109_1 and a first modulator 110_1, wherein the first modulator 110_1 is configured to apply a phase shift to the signal 120 to be modulated in order to reduce limit cycles, e.g., around half of the sampling rate Fs/2.

The second MEMS microphone 102_2 comprises a second MEMS microphone unit 104_2, a second amplifier unit 106_2 (e.g., a source follower), a second analog-to-digital converter (ADC) 108_2, a second digital filter 109_2 and a second modulator 110_2, wherein the second modulator 110_2 is configured to apply a phase shift to the signal 120_2 to be modulated in order to reduce limit cycles, e.g., around half of the sampling rate Fs/2.

As shown in FIG. 6 by way of example, the first modulator 110_1 and the second modulator 110_2 can be configured to apply a delay as the phase shift to the signal to be modulated, wherein the delay can be equal to a fraction of one sampling period. For example, both the first modulator 110_1 and the second modulator 110_2 can be implemented as shown in the embodiment of FIG. 5 and apply a gain value of a=0.7 in the filter chain of the phase shifter. Naturally, it is also possible that the first modulator 110_1 and the second modulator 110_2 apply different gain values in the filter chains of the phase shifters.

Further, as shown in FIG. 6, the two MEMS microphones 102_1 and 102_2 can be connected via a single line 114, for example, to a digital signal processor (DSP). A configuration bit 116 (select L/R) can be used to determine which MEMS microphone 102_1 and 102_2 is scanned with the rising edge of the clock and which is scanned with the falling edge of the clock.

In other words, FIG. 6 shows a schematic block diagram of a digital filter path of a stereo application (ASIC). It is apparent that modulators with phase shift (a=0.7) are used.

Subsequently, simulation results of the stereo application shown in FIG. 6 are discussed making reference to FIGS. 7 to 10.

Figure 7:
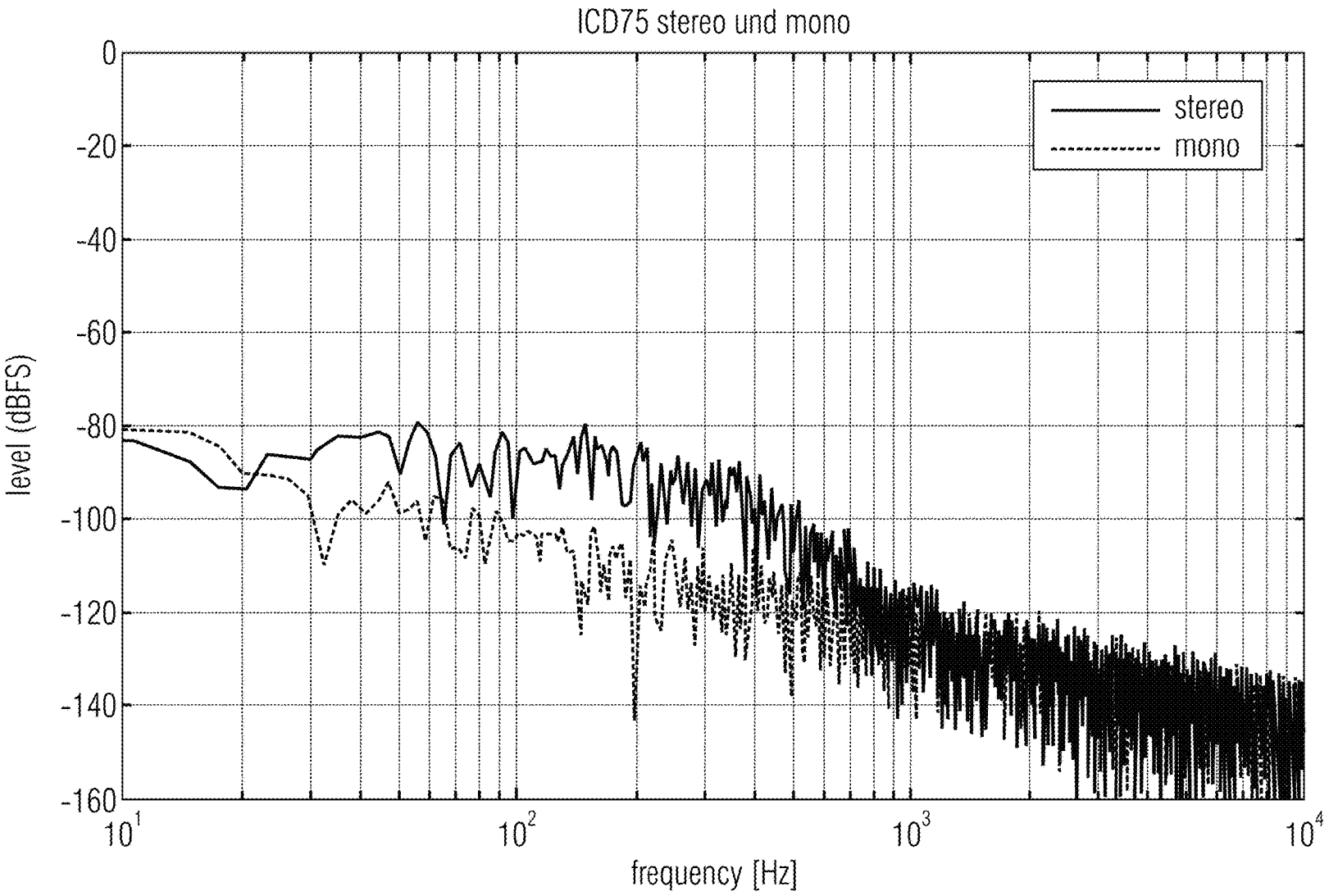
FIG. 7 shows in a diagram the stereo noise of the MEMS microphone module of FIG. 1 with modulators without phase shifters plotted over frequency (stereo), and for comparison the noise of a modulator of a single MEMS microphone plotted over frequency (mono)

FIG. 7 shows in a diagram the stereo noise of the MEMS microphone module of FIG. 1 with modulators without phase shifters plotted over frequency (stereo), and for comparison the noise of a modulator of a single MEMS microphone plotted over frequency (mono). Thereby, the ordinate denotes the level in dBFS, wherein the abscissa denotes the frequency in Hz. In other words, FIG. 7 illustrates the stereo noise for modulators without phase shift (a=1).

Figure 8:
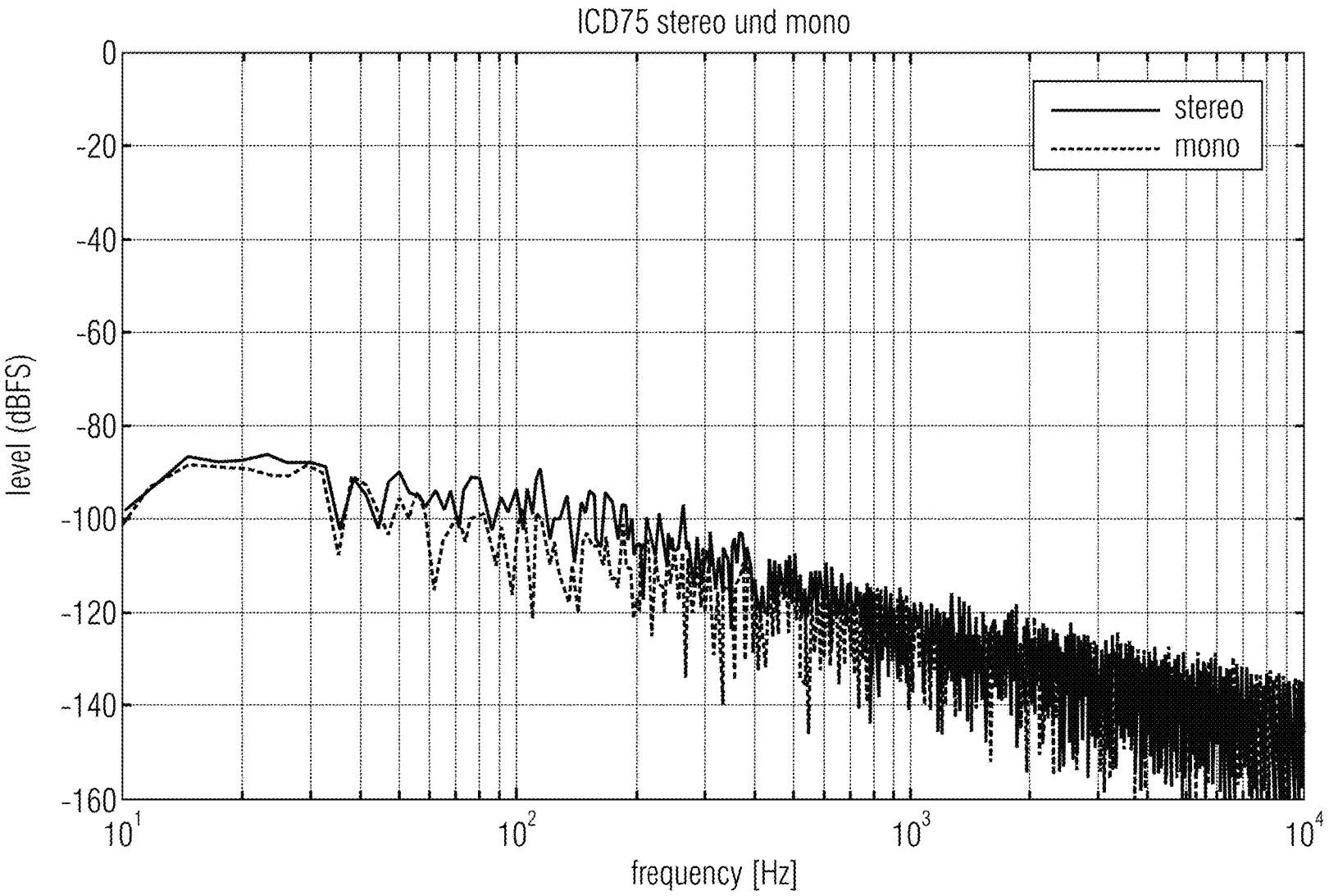
FIG. 8 shows in a diagram the stereo noise of the MEMS microphone module of FIG. 6 with modulators with phase shifters plotted over frequency (stereo), and for comparison the noise of a modulator of a single MEMS microphone plotted over frequency (mono)

FIG. 8 shows in a diagram the stereo noise of the MEMS microphone module of FIG. 6 with modulators with phase shifters plotted over frequency (stereo), and for comparison the noise of a modulator of a single MEMS microphone plotted over frequency (mono). Thereby, the ordinate denotes the level in dBFS, wherein the abscissa denotes the frequency in Hz. In other words, FIG. 8 illustrates the reduced stereo noise as a result of the effects of the phase shift (a=0.7).

Figure 9:
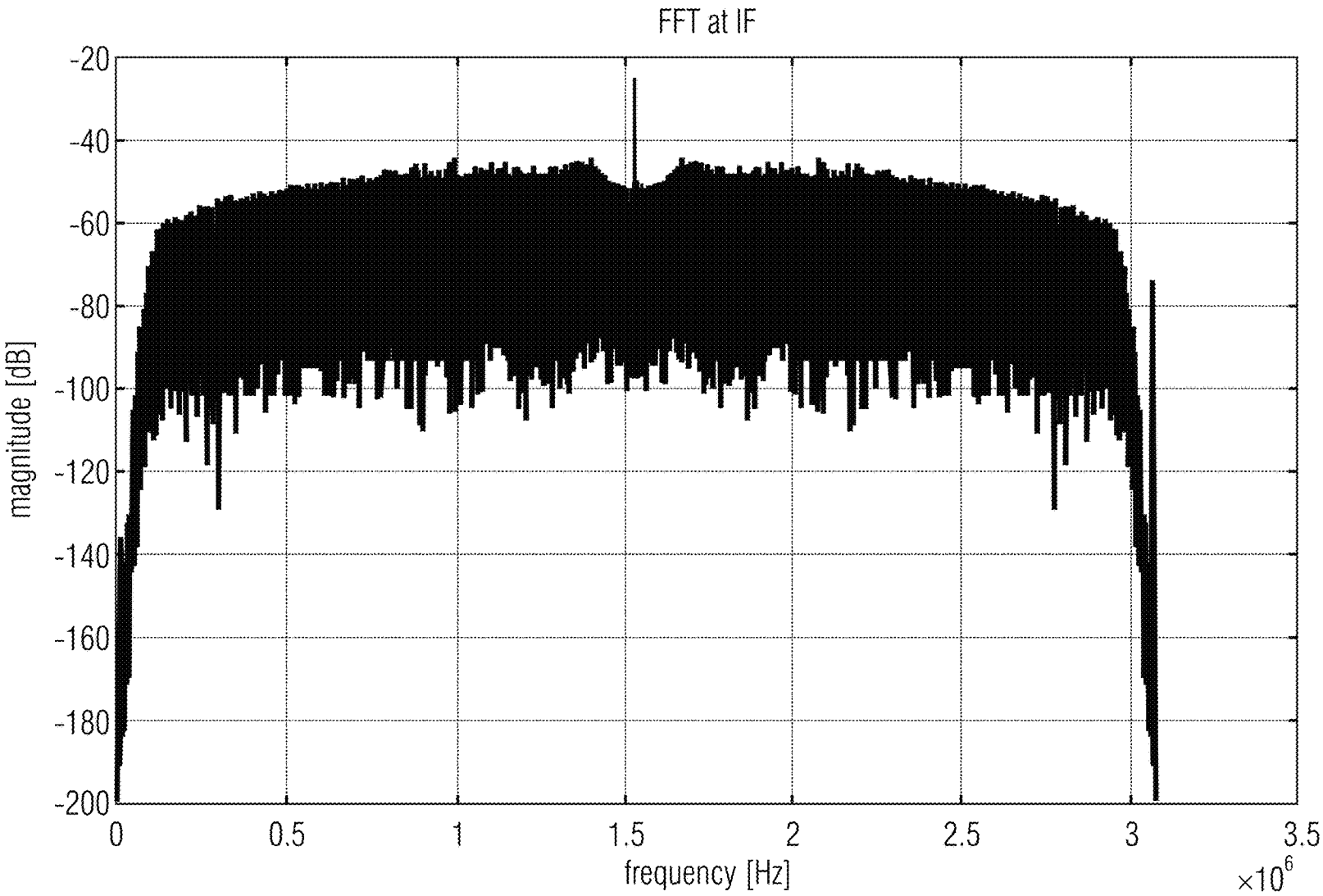
FIG. 9 shows in a diagram the pronounced limit cycles at halt of the sampling frequency Fs/2 when using a modulator without phase shifter.

FIG. 9 shows in a diagram the pronounced limit cycles at halt of the sampling frequency Fs/2 when using the modulator without phase shift (a=1). Thereby, the ordinate denotes the magnitude in dB, wherein the abscissa denotes the frequency in Hz.

Figure 10:
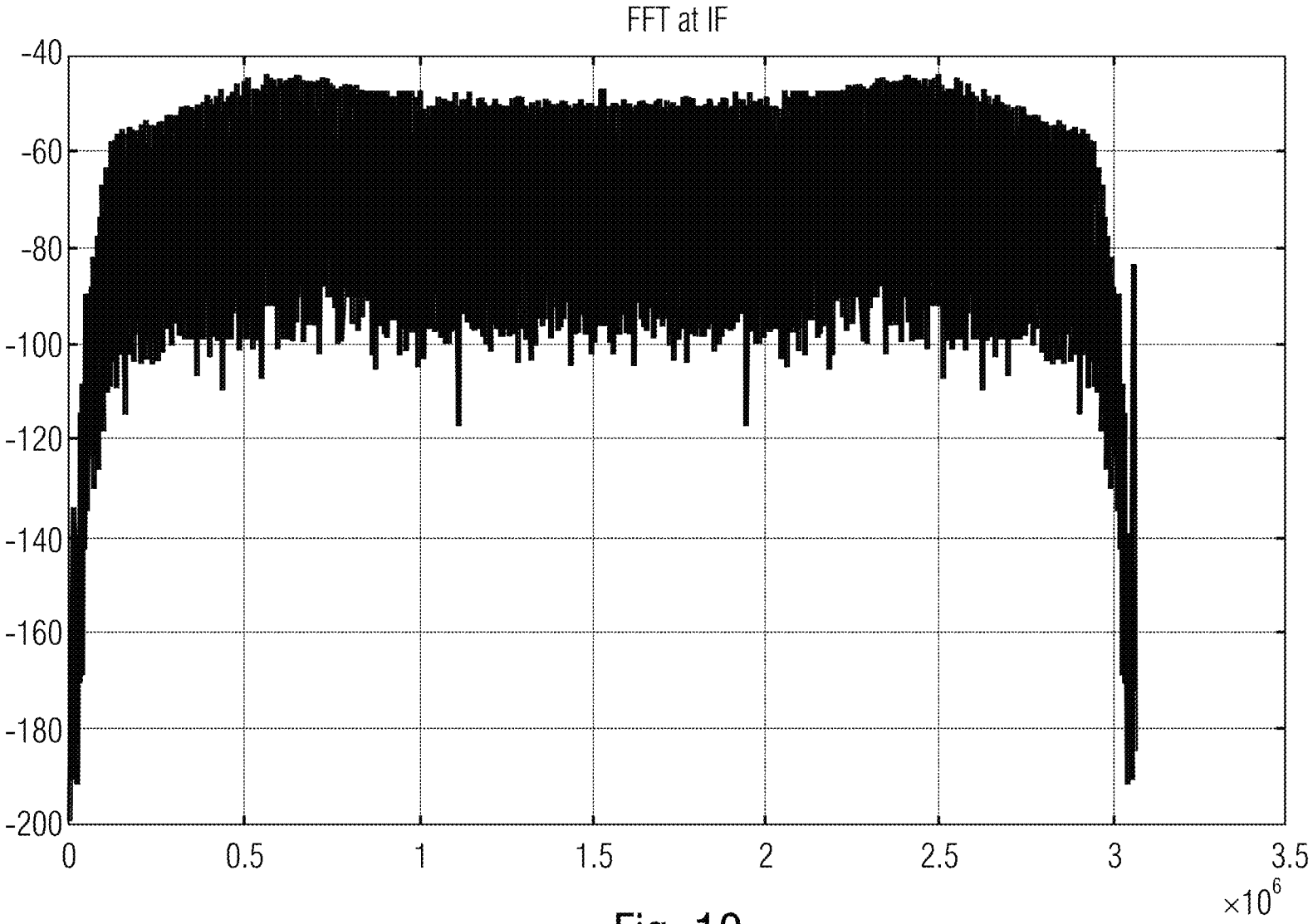
FIG. 10 shows in a diagram the greatly reduced limit cycles when using a modulator with a phase shifter.

FIG. 10 shows in a diagram the greatly reduced limit cycles when using the modulator with a phase shift (a=0.7). Thereby, the ordinate denotes the magnitude in dB, wherein the abscissa denotes the frequency in Hz.

Figure 11:
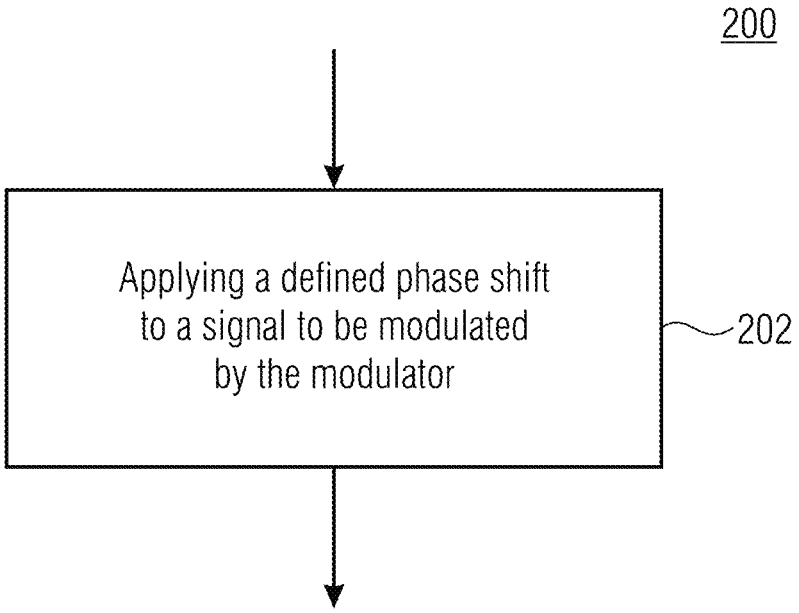
FIG. 11 shows a flowchart of a method for operating a MEMS microphone according to an embodiment.

FIG. 11 shows a flowchart of a method 200 for operating a MEMS microphone according to an embodiment. The MEMS microphone comprises a MEMS microphone unit and a modulator connected downstream the MEMS microphone unit. The method 200 comprises a step 202 of applying a defined phase shift to a signal to be modulated by the modulator.

Embodiments provide a MEMS microphone comprising a MEMS microphone unit and a modulator connected downstream the MEMS microphone unit, wherein the modulator is configured to apply (e.g., prior to modulation) a defined phase shift to a signal to be modulated (e.g., to be modulated by the modulator; e.g., a signal present at an input of the modulator or a signal derived therefrom; e.g., a signal of a signal chain of the modulator).

In embodiments, the modulator is configured to apply the defined phase shift to the signal to be modulated in order to reduce limit cycles of the modulator.

In embodiments, the modulator is configured to apply an adjustable phase shift to the signal to be modulated.

In embodiments, the modulator is configured to adjust the phase shift in dependence on a level of the signal to be modulated.

In embodiments, the modulator is configured to apply a delay as the phase shift to the signal to be modulated.

In embodiments, the delay is equal to a sampling period of the signal to be modulated or a fraction or a multiple thereof.

In embodiments, the modulator is a digital modulator.

In embodiments, the modulator is a sigma-delta analog-to-digital converter.

In embodiments, the modulator is a single bit modulator.

In embodiments, the modulator comprises a phase shifter configured to apply the defined phase shift to the signal to be modulated.

In embodiments, the modulator comprises a quantizer connected downstream the phase shifter.

Embodiments provide a MEMS microphone module, comprising a first MEMS microphone and a second MEMS microphone, wherein the first MEMS microphone comprises a first MEMS microphone unit and a first modulator connected downstream the first MEMS microphone unit, wherein the first modulator is configured to apply a defined phase shift to a signal to be modulated, wherein the second MEMS microphone comprises a second MEMS microphone unit and a second modulator connected downstream the second MEMS microphone unit, wherein the second modulator is configured to apply a defined phase shift to a signal to be modulated.

In embodiments, the modulators of the first MEMS microphone and the second MEMS microphone are configured to apply different phase shifts to the signals to be modulated.

Further embodiments provide a method for operating a MEMS microphone, the MEMS microphone comprising a MEMS microphone unit and a modulator connected downstream the MEMS microphone unit, wherein the method comprises a step of applying a defined phase shift to a signal to be modulated by the modulator.

Further embodiments provide a computer program for performing, when running on a computer or microprocessor, a method for operating a MEMS microphone, the MEMS microphone comprising a MEMS microphone unit and a modulator connected downstream the MEMS microphone unit, wherein the method comprises a step of applying a defined phase shift to a signal to be modulated by the modulator.

Further embodiments provide an apparatus for operating a MEMS microphone, the MEMS microphone comprising a MEMS microphone unit and a modulator connected downstream the MEMS microphone unit, wherein the apparatus comprises means for applying a defined phase shift to a signal to be modulated by the modulator.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine-readable carrier.

Other embodiments comprise the computer program for performing one of the methods described herein, stored on a machine-readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are preferably performed by any hardware apparatus.

The apparatus described herein may be implemented using a hardware apparatus, or using a computer, or using a combination of a hardware apparatus and a computer.

The apparatus described herein, or any components of the apparatus described herein, may be implemented at least partially in hardware and/or in software.

The methods described herein may be performed using a hardware apparatus, or using a computer, or using a combination of a hardware apparatus and a computer.

The methods described herein, or any components of the apparatus described herein, may be performed at least partially by hardware and/or by software.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A MEMS microphone, comprising:

a MEMS microphone unit, and a modulator connected downstream from the MEMS microphone unit, wherein the modulator is configured to apply a defined phase shift to a signal to be modulated, wherein the modulator is configured to apply an adjustable phase shift to the signal to be modulated, and wherein the modulator is configured to adjust the adjustable phase shift in dependence on a magnitude level of the signal to be modulated.

2. The MEMS microphone according to claim 1, wherein the modulator is configured to apply the defined phase shift to the signal to be modulated in order to reduce limit cycles of the modulator.

3. The MEMS microphone according to claim 1, wherein the modulator is configured to apply a delay as the phase shift to the signal to be modulated.

4. The MEMS microphone according to claim 3, wherein the delay is equal to a sampling period of the signal to be modulated or a fraction or a multiple thereof.

5. The MEMS microphone according to claim 1, wherein the modulator is a digital modulator.

6. The MEMS microphone according to claim 1, wherein the modulator is a sigma-delta analog-to-digital converter.

7. The MEMS microphone according to claim 1, wherein the modulator is a single bit modulator.

8. The MEMS microphone according to claim 1, wherein the modulator comprises a phase shifter configured to apply the defined phase shift to the signal to be modulated.

9. The MEMS microphone according to claim 8, wherein the modulator comprises a quantizer connected downstream of the phase shifter.

* * * * *